US005862961A

United States Patent [19]

Motta et al.

[11] Patent Number: 5,862,961

[45] **Date of Patent: *Jan. 26, 1999**

[54] CONNECTION DEVICE FOR DISPENSING FLUID FROM A BOTTLE

[75] Inventors: Carlos Fernando Carvalho Motta; Francisco De Assis Reis Freitas, both of Rio de Janeiro, Brazil

[73] Assignee: IMI Cornelius Inc., Anoka, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 950,007

[22] Filed: Oct. 14, 1997

Related U.S. Application Data

[63] Continuation of Ser. No. 637,668, filed as PCT/BR94/00032, Oct. 26, 1994, abandoned.

[30] Foreign Application Priority Data

Oct. 26, 1993 [BR] Brazil ..... 9304363

[51] Int. Cl.[6] ..... B65D 83/00

[52] U.S. Cl. ..... 222/400.7; 137/212

[58] Field of Search ..... 222/82, 85, 91, 222/325, 400.7; 137/212

[56] References Cited

U.S. PATENT DOCUMENTS

| | | | |
|---|---|---|---|
| 3,498,313 | 3/1970 | Belich | 137/322 |
| 3,685,694 | 8/1972 | Ianelli | 222/325 X |
| 4,612,952 | 9/1986 | Fallon | 137/212 |
| 5,105,982 | 4/1992 | Takahashi et al. | 222/82 |
| 5,351,859 | 10/1994 | Jansen | 222/400.7 X |

FOREIGN PATENT DOCUMENTS

| | | |
|---|---|---|
| 0 224 380 | 6/1987 | European Pat. Off. . |
| 0 226 713 | 7/1987 | European Pat. Off. . |
| 94 10081 | 5/1994 | WIPO . |

*Primary Examiner*—Gregory L. Huson
*Attorney, Agent, or Firm*—Sten Erik Hakanson

[57] ABSTRACT

The present invention is a device for attaching to a bottle for permitting the sanitary extraction of fluid there from through the use of pressurized air. The extraction device herein includes two major parts, a flow regulating portion and a flow actuating portion. The flow regulating portion is secureable to the neck end of the bottle and includes valve mechanisms for regulating and directing the flow of liquid and air. The actuating portion is releaseably securable to the regulating portion and includes structure for opening the liquid flow valve mechanism, for directing air flow from an outside source to the air valve mechanism and for directing the flow of the liquid contents out of the bottle. The flow actuating mechanism is also further constructed so that the flows of air and liquid are maintained fluidly separate from each other.

25 Claims, 4 Drawing Sheets

11
Qμ1
21
22
12
2
H
Qμ2
36
34
35
10
33
I
31
29
38
28
0
29'
6
S'
32

1
17a
3
23
19a
5
19b
17b
24
17c
26
4
9
14
32'
28
Qμ2
13
27
U'
16
8
Qμ1

17a
1
19b
23
Qμl
17b
4
4
19a
5
5'
17c
9
26
32'
28
5
27
34
32
35
16
8
Qμ2

19a
33"
15"
19b
33'
5
25
15
33'
15'

11
$Q_{u1}$
21
2
22
12
$Q_{u2}$
36
37
34
30
31
35
10
29
28
39
6
29'
38
6
S'
6
32

28
29
10
32
39
6

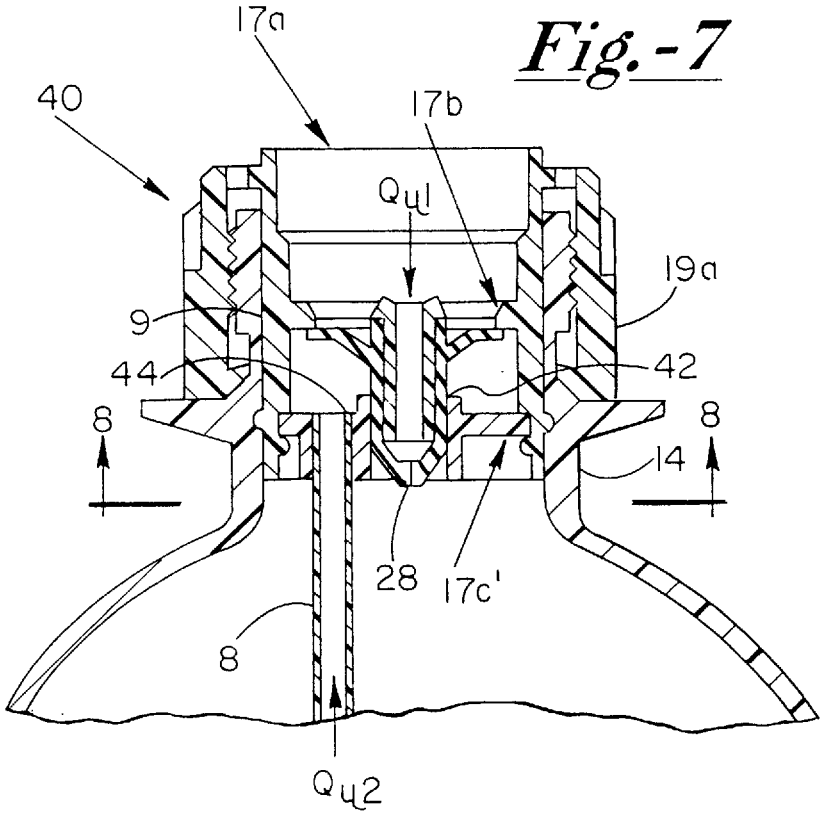
Fig.-7
Fig.-8
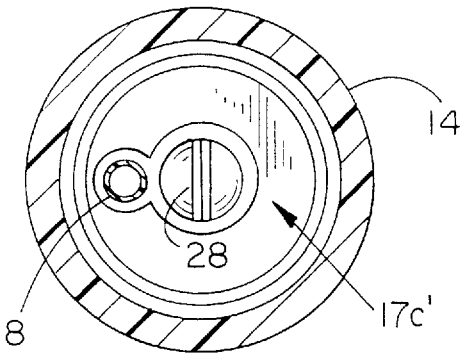

CONNECTION DEVICE FOR DISPENSING FLUID FROM A BOTTLE

This is a continuation of application Ser. No. 08/637,668, field as PCT/BR94/00032, Oct. 26, 1994, now abandoned.

FIELD OF THE INVENTION

The present invention relates to fluid devices for connection to a bottle for providing extraction of fluids contained therein, and specifically to such devices for extracting fluids from a bottle by simultaneous administration of compressed gas therein.

BACKGROUND OF THE INVENTION

Various systems exist for combining two or more liquids to produce a desired final fluid product. In the drinks dispense industry, post-mix beverage dispensing equipment is known to combine carbonated water with a beverage concentrate syrup to produce a carbonated beverage.

Containers holding the syrup are usually made of stainless steel and are reused after being cleaned and refilled. However, the size of the containers can be a problem where the specific flavor is a low volume one where the unused contents can become out of date before being consumed. The cleaning and refilling thereof can also generate additional cost. Bag-in-box syrup containers are also known that have the advantage of being disposable. However, pumps are required to remove the syrup therefrom. Both types of syrup containers can be inconvenient in requiring a variety of differentiated couplings for the various pressurization or suction line connections thereto.

Accordingly, it would be desirable to have a smaller less costly syrup container that is easy to use and to connect to its associated beverage dispensing equipment.

SUMMARY OF THE INVENTION

The present invention comprises an extraction device for securing to an open neck end of a bottle that creates first and second fluidly separate pathways that permit simultaneous injection into the bottle of a pressurized gas through the first pathway for forcing the liquid contents out of the bottle through the second pathway.

The invention herein includes a bottle connecting portion and a flow actuating portion. The bottle connecting portion is releasably securable to the bottle neck or open end. The connecting portion includes an inner perimeter cylindrical portion that is inserted into the neck of the bottle wherein an outer surface thereof is positioned tightly adjacent an inner surface of the neck of the bottle. A horizontal floor portion extends substantially centrally of the cylindrical portion and internally thereof. The floor portion has a central gas flow orifice there through and a plurality of fluid flow openings also extending there through and positioned equidistantly around the gas flow orifice. A gas flow orifice tube is integral with and extends from the gas flow orifice from a bottom surface of the floor portion. The gas flow orifice tube includes a gas flow passage extending centrally there through and in fluid communication with the gas flow orifice. A flexible valve means or obturator is a unitary structure made entirely of a resilient material, such as rubber, and includes a central duck bill type valve portion having a central gas passage extending from a proximal end thereof to a distal or duck bill valving end. Around a perimeter of the proximal end of the central gas passage and integral therewith extends a circular and annular fluid valving surface. The flexible valve means is secured underneath the floor portion wherein the gas flow orifice tube is inserted into the central gas passage and retained therein by the resilience of the valve means whereby the central gas passage is sized to slightly stretch the central gas passage. When positioned thereon, the annular valving surface is positioned directly adjacent the bottom surface of the floor portion and covers and blocks the plurality of fluid openings.

A gas flow directing structure is secured to a lower end of the cylindrical portion of the bottle connecting portion. The gas flow directing structure positions a retaining tube section centrally and below the floor portion whereby the duck bill valving portion is inserted or positioned within the tube section. An elongate gas flow tube is secured to a distal end of the tube section and extends therefrom to a position adjacent a bottom end of the bottle.

The flow actuating portion is designed to be releasably securable to the bottle connecting portion and to thereby create the separate fluid and gas flow paths for permitting the extraction of fluid from the bottle. The flow actuating portion is itself comprised of four major components, a fluid housing or connection portion, an actuator, an inserting member and a skirt or connecting member. When secured together the fluid connection portion and the inserting member define an internal fluid flow space wherein the actuator is retained. A lip or shoulder portion of the skirt member is held between the fluid housing and the inserting member. The housing portion includes a gas inlet fitting for releasable connecting to a source of pressurized gas, and a fluid outlet fitting for releasable connecting to a line for directing the bottle's contents to a desired point.

The fluid outlet fitting is in fluid communication with the internal fluid flow space. A gas inlet cylindrical extension is in fluid tight connection with the gas inlet and extends partially into and terminates within the fluid flow space. The cylindrical extension includes an interior channel for receiving the actuator. The actuator is a tube slideably positioned within the interior channel and extends from a proximal end thereof within the channel to a distal end exterior thereof and within the fluid flow space. The distal end of the actuator includes a resilient seal including an end piece having a gas channel centrally there through in fluid communication with an interior channel of the actuator. The actuator central channel extends centrally there through for providing fluid communication from the gas inlet fitting to the gas orifice of the resilient end piece. A resilient annular ring seal is secured to a distal end of the gas outlet cylindrical extension and provides for fluid tight sealing around the actuator tube for preventing any flow of fluid or gas exchange between the interior channel of the cylindrical extension and the interior fluid flow space. A coil spring is positioned around the actuator tube between a distal end thereof and the distal end of the cylindrical extension for biasing the sliding movement of the actuator tube in a distal direction towards an annular valve seating surface of the inserting member. The annular valve seating surface surrounds a fluid flow hole extending through the inserting member. The resilient or sealing end piece includes a middle section sized to extend through the fluid hole and includes an annular skirt portion for contacting and sealing with the valve seating surface. Thus, the spring holds the resilient end piece in a normal position with the skirt portion thereof sealed against the annular seating surface and with the middle section extending through and beyond the fluid hole.

The inserting member includes a plurality of fluid valving structures or protrusions extending from a distal end exterior thereof around the fluid hole. The protrusions are designed to insert into the fluid openings of the floor portion thereby deflecting the annular resilient valve surface away from the underside of the fluid openings when the flow actuating portion and the bottle connecting portion are secured together.

In operation, the bottle connecting portion is first secured to the bottle neck end whereby the elongate gas tube is inserted into the bottle and terminating adjacent a bottle bottom end. The flow actuating portion can then be secured to the connecting portion whereby, as indicated above, the fluid valving structures are inserted into the fluid openings deflecting the resilient valve surface for permitting fluid flow of the fluid there through. At the same time the resilient end middle section comes in contact with a top seating surface of the floor portion central gas flow orifice. The floor portion is positioned at a level such that as the fluid valving structures are inserted into the fluid openings, the middle section of the resilient end piece is pushed against the seat surface of the central gas flow orifice creating a fluid tight connection there between. Thus, the actuator tube is deflected against the spring whereby the skirt portion of the resilient end piece is moved away from contact with the annular seating surface so that fluid can then flow through the plurality of fluid openings into the fluid flow interior and out of the fluid outlet. Thus, it can be appreciated that by applying gas pressure to the gas inlet, gas can flow through the actuator and end piece thereof, through the gas orifice and the gas tube section and into the gas channel of the valving piece opening the duck bill valve portion thereof. The gas is then directed by the gas directing structure into the elongate tube to a position adjacent the bottom end of the bottle. With the bottle in an inverted position, it can be understood that the syrup can then be more advantageously forced by the pressurized gas to flow through the fluid openings and into the fluid flow space and out the outlet.

The connection device of the present invention permits connection to a beverage dispensing machine thereby permitting a low cost lower volume syrup reservoir. The bottle connecting portion is provided with tamper-sensitive means for protecting and identifying the type and origin of the concentrate and where the vlaving structure therein further serves to protect the bottle contents. It can be appreciated by those of skill that the present invention can be manufactured relatively inexpensively by virtue of the space disposition of the internal flow-blocking elements and the resilient properties of their materials. Sanitary and low cost plastic material such as high and low density polyethylene, centroprene or equivalent rubbers are employed in the manufacture thereof.

The bottle with the extraction assembly of the present invention secured thereto can operate in any position from 360° with respect to the horizontal plane, that is to say, the work positions of the bottle can be both downwards and upwards, with three possibilities of extracting liquid from the container, namely, by pressure, by gravity and by pumping, and all the combinations thereof. As a result of the teachings of the present invention, the suction pumps, the reservoirs of stainless steel and bag-in-box of the prior art are eliminated and replaced by the known disposable bottles. In addition to that advantage, the user has the possibility of storing many different concentrate bottles with a rapid replacement of flavors, with a considerable reduction of space and costs as would be had with the traditional containers used in the prior art.

DESCRIPTION OF THE DRAWINGS

A further understanding of the structure, operation, features and advantages of the present invention will become more apparent in conjunction with the following detailed description of the preferred embodiment, which refers to the following drawings, wherein:

FIG. 3 shows a side plan cross-sectional view of the flow actuating portion with the regulating tube thereof in its normal extended position blocking any liquid fluid flow there through.

FIG. 7 shows a side plan cross-sectional view of an alternate embodiment of the bottle insertion portion.

FIG. 8 shows a bottom plan cross-sectional view along lines 8—8 of FIG. 7.

DETAILED DESCRIPTION OF PREFERRED EMBODIMENTS

Figure 2:
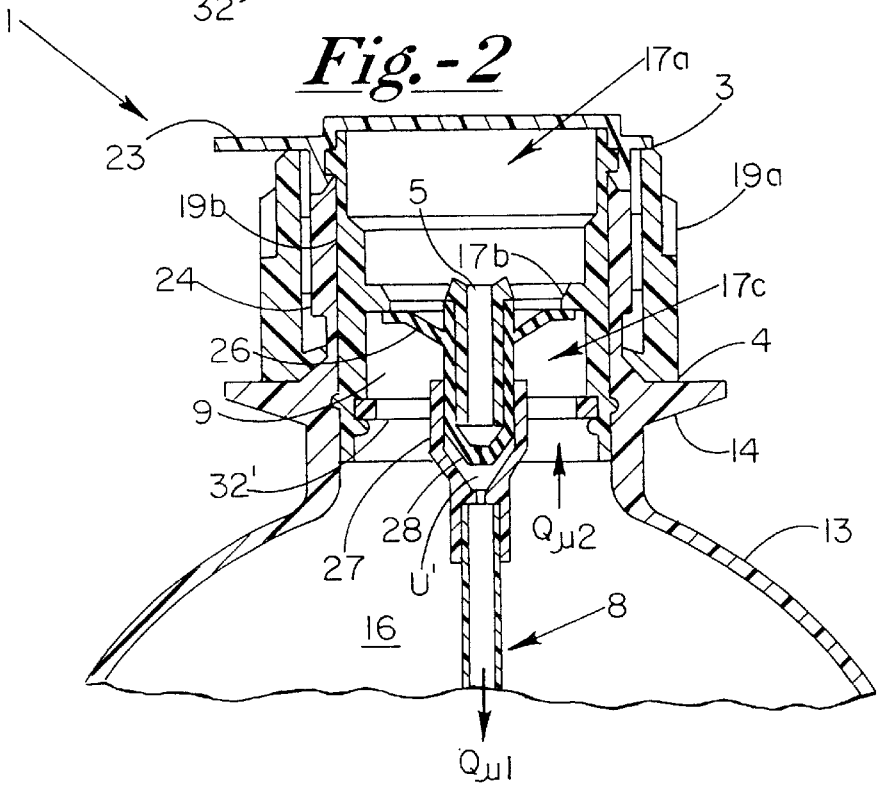
FIG. 2 shows a side plan cross-sectional view of the bottle connecting portion connected to a bottle.
Figure 3:
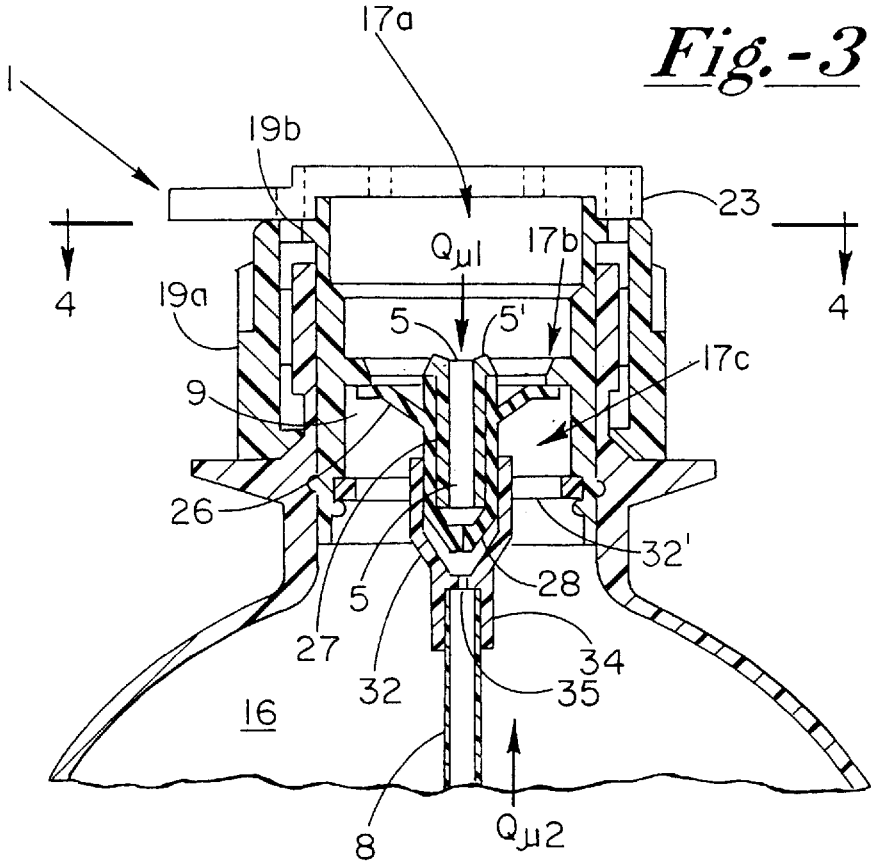
Figure 4:
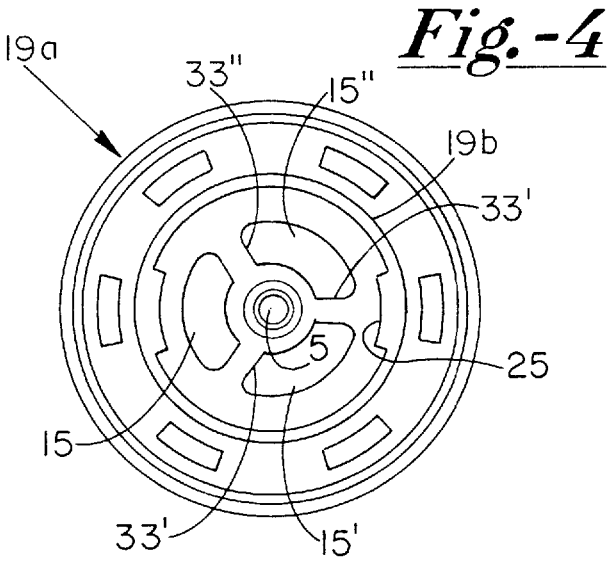
FIG. 4 shows a top plan cross-sectional view along lines 4—4 of FIG. 3

The bottle connecting portion is seen in FIGS. 2–4, and generally referred to by the numeral 1. Connecting portion 1 is secured to a neck 14 of a known bottle 13 of the PET type. The body of the device 1 defines a cavity delimited by a continuous skirt wall 19*a*, the height of which is delimited by peripheral upper and lower edges, 3 and 4 respectively. A removable cap 23 provided with tamper-sensitive means is releasably secured to the peripheral upper edge 3. Connecting portion 1 is open on the opposed perimeter edge 4 to the interior 16 of the container 13. The skirt 19*a* is internally provided with conventional threads 24 or similar means for engagement with the neck 14 of the container 13.

According to the preferred embodiment, the reference number 19*b* indicates a cylindrical portion having a wall having a smaller external diameter than the internal diameter of the neck 14 with a peripheral face and an internal face opposite each other, which extend along said neck cavity. The cylindrical internal portion 19*b* and the external cylinder 19*a* are joined by bridges alternating with the tamper-sensitive means of the cap 23 so as to define a peripheral circular space for receiving neck 14 of the container 13. The inner face of the cylindrical wall 19*b* delimits a central space, which extends longitudinally from the cap 23 to the opposed open end along a first upper end region 17*a*, an intermediate barrier region or floor portion 17*b* and a lower end region 17*c*. The reference numbers 26 and 28 indicate internal valve means that regulate the flow of two separate fluids Qu1 and Qu2 of different viscosity. Qu1 and Qu2 can pass in opposed directions between the upper and lower end regions 17*a*, 17*c* substantially at the same time as will be described in greater detail herein below.

The floor portion 17*b* is substantially located at the mid point of cylinder 19*b* and includes a central gas orifice 5 there through and three fluid flow openings or passages 15, 15', 15" extending there through and radially around orifice 5. The holes 15, 15' and 15" are in part defined by arms 33, 33' and 33". One or more projections 25 extend from the internal surface of cylinder 19*b*. A tubular portion 27 extends from and around the orifice 5 and downward therefrom from a bottom side of the floor portion 17*b*. The internal valve device is a unitary structure made of a resilient material and includes the valve portions 26 and 28 thereof. Valve 28 can be understood to be a normally closed vernier or duck bill valve having the tube 27 received centrally thereof. The other valving mechanism 26 can be understood to consist of an annular resilient washer or ring that is nomally positioned against the underside of the floor portion 17*b* and blocks or covers the openings 15, 15' and 15", and is connected to valve 28 by arms 28'. A spacer 32 is secured closely to and around an outer surface of valve 28 and is connected by arms 32' to the internal wall of cylinder 19*b* of the device 1. The spacer 32, in longitudinal section, is H-shaped and defines an upper space U'. Space H communicates fluidly through a central bore 35 to a space defined by a perimeter wall 34. Space H securely receives valve 28 therein. A proximal end of an elongate tube 8 sized to fit tightly within wall 34 the space defined by wall 34 and extend therefrom to a distal tube end adjacent a bottom of the bottle 13. Orifice 5, tube 27, valve 28, the central bore 35 of the spacer 32 and the tube 8 are aligned and provide for fluid communication of a gas there through. A seat area 5' extends around orifice 5 on a top surface of floor portion 17*b*.

An annular chamber 9 is open in the direction of the lower region 17*c* and blocked in the direction of the upper region 17*a* of the device 1 by the plurality of passages 15, 15', 15", located in the floor portion 17*b*, which are normally closed by the respective annular washer of valve 26 from the lower region 17*c*.

Figure 1:
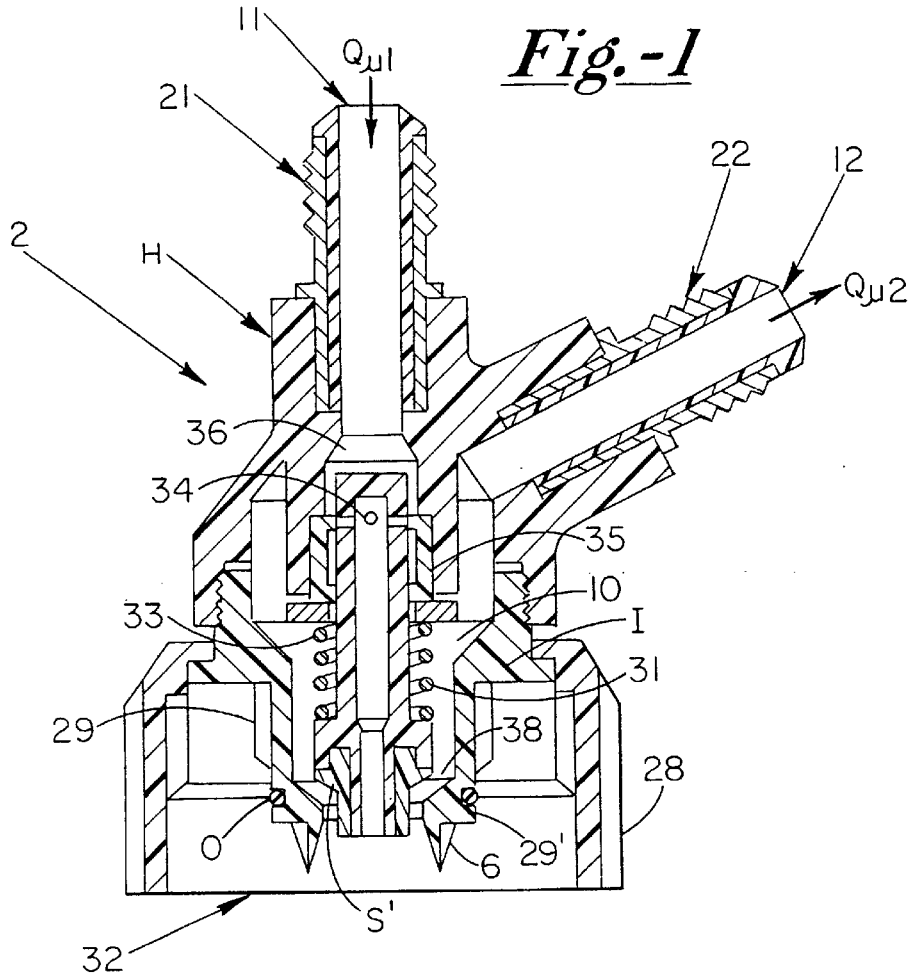
FIG. 1 shows a side plan cross-sectional view of the flow actuating portion with the regulating tube thereof deflected to permit fluid flow there through out of the fluid outlet thereof.
Figure 5:
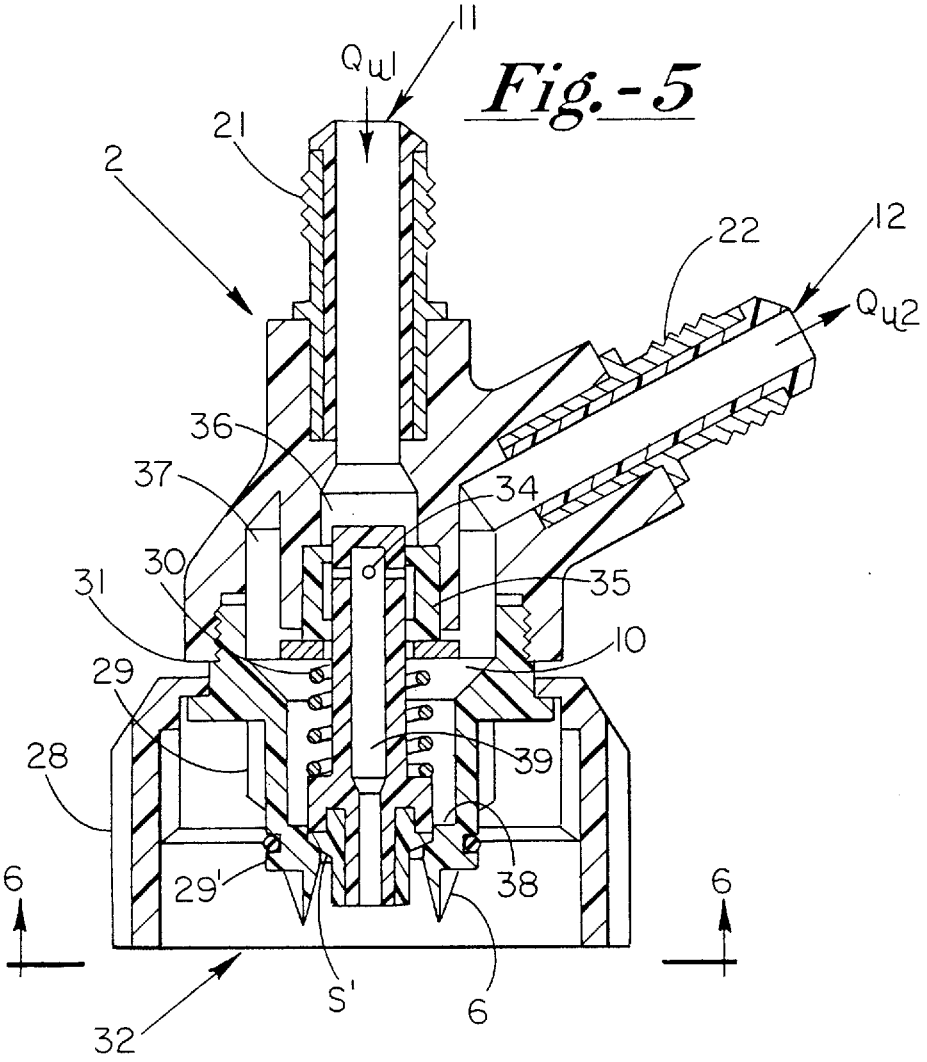
FIG. 5. shows an enlarged side plan cross-sectional view of the bottle connecting portion connected to a bottle.
Figure 6:
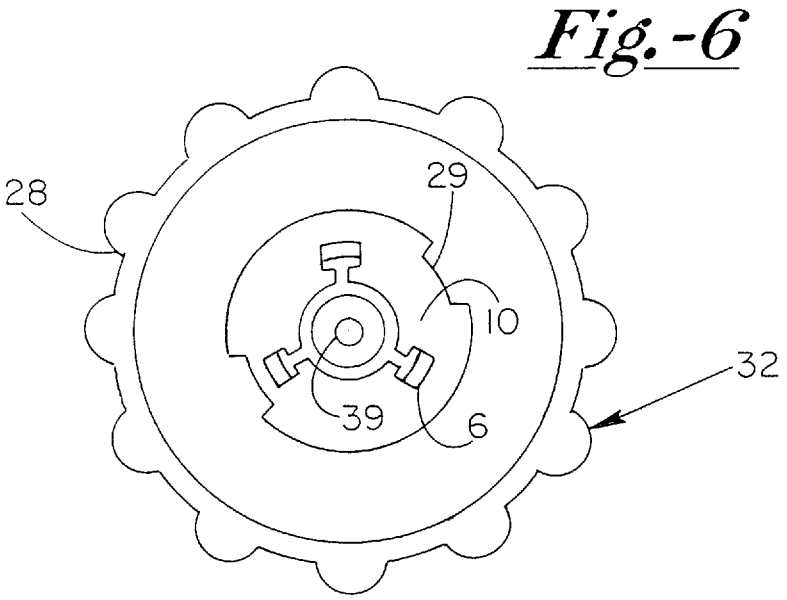
FIG. 6 shows a view along lines 6—6 of FIG. 5.

A flow actuating portion generally designated 2, is seen by referring to FIGS. 1,5 and 6. Actuating portion 2 includes a housing portion H and inserting member I and a peripheral skirt attachment portion 28 for facilitating releasable securing of flow actuating portion 2 with bottle connecting portion 1. Skirt 28 includes a bottom perimeter edge 32 sized to extend closely around an exterior surface of cylindrical portion 19a and secure thereto by interaction therewith, as by threadable engagement. Housing portion H includes a gas inlet fitting 11 and a fluid outlet fitting 12 for facilitating connection to a source of pressurized gas and to a beverage dispensing machine, respectively. Fittings 11 and 12 include threaded portions 21 and 22 for facilitating such connections. Skirt 28 includes a lip or shoulder area that is retained between housing portion H and inserting member I.

A retractile central gas tube or actuator 31 is slideably secured within an internal fluid flow space 10 of actuating portion 2. Flow space 10 is created and defined by the securing together of the housing portion H and the inserting member I. Actuator 31 is a tube having a central channel or axial bore 39 extending between a proximal closed end and a distal open end. A further transverse bore 34 adjacent the proximal end intersects with channel 39 forming a "T". Actuator 31 is retractile and tensioned by a spring 30, and the closed end thereof is downstream of the inlet fitting 11 and includes an annular seal S' there around. Seal S' is engageable with an annular perimeter seating surface 38 extending around a hole of the inserting member and in fluid communication with the interior space 10. The opposite open end is engageable with seat 5' of the upper end of the tubular portion 27 of the bottle connecting portion 1. An annular seal 35 serves to guide and seal the exterior surface of actuator 31 near said closed end. In its normal extended position, seen in FIG., 4, bore 34 of actuator 31 is blocked by seal 35. A cavity 36 is located upstream of the seal 35 for receiving the bore 34 when actuator 32 is in its retracted position as seen in FIG. 1. It can be appreciated by those of skill that fluid communication is provided from inlet 11 through intersecting bores 34, into the central axial channel of actuator 31 and to the open end thereof when actuator 31 in the retracted position. Seal 35 also prevents fluid communication between inlet 11 and interior fluid flow space S when actuator is in either the retracted or normal extended positions. Inserting member I includes one or more slots 29 or 29' for cooperating with ridges 25 of bottle connecting portion 1. An o-ring "O" provides for fluid tight scaling between inserting member I and an interior surface of cylindrical portion 19*b*. A plurality of protrusions or claws 6 extend from a distal end of the inserting member I. The tensioning force of the spring 30 maintains the seal S' against the perimeter annular seating surface 38.

In operation, after bottle connecting portion 1 is secured to a bottle 13 and the cap 23 is removed, actuating portion 2 can be joined there with. Skirt 28 is secured to cylinder portion 19*a* and the claws 6 are inserted into holes 15, 15' and 15". The reciprocal coupling between the devices 1 and 2 overcomes the tensioning force of the spring 30 wherein the open end of actuator 31 is pressed against the seat 5' causing actuator 31 to retract into the cavity leaving the bore 34 unblocked therein. As actuator 31 presses against seat 5' a sealing is provided there between so that a pressurized gas Qu1 can flow in a fluid tight manner from the inlet 11 through to the central gas channel 5 of tubular extension portion 27 and into the duck bill valve 28. Valve 28 is then opened by such pressurized gas permitting a one way flow of the gas into the elongate tube 8 as directed by the spacer 32. Simultaneously, the claws 6 have been inserted into the fluid flow holes 15, 15' and 15" moving against the annular washer 26 thereby unblocking holes 15, 15' and 15" for permitting the flow of a fluid Qu2 there through. As will be appreciated by those of skill, with the bottle in an inverted position, the pressurized gas will begin to fill the bottle interior space 16 and force the fluid Qu2 retained therein through the now open fluid flow passages 15, 15' and 15". The fluid then flows into the now open fluid flow space between annular surface 38 and the seal S' created by the retraction of actuator 31. Once in the fluid flow space, the fluid can then flow out of the fluid outlet 12 to a dispense point thereof.

The slots 29, and/or 29' are sized to cooperate proportionately sized ridges 25 of cylinder 19*b* so as to provide for a unique connection between various actuating portions 2 and their corresponding bottle connecting portions 1. In this manner a coding mechanism can be provided for wherein different orientations of ridges and slots correspond to particular flavors of syrup to insure that the proper actuating portions 2 and bottle connecting portions 1 are connected together.

A further embodiment of the bottle connecting portion 1 is seen in FIGS. 7 and 8, and generally referred to by the numeral 40. Embodiment 40 is the same as embodiment 1, except that element 17*c*' comprises a solid disk structure. Disk 17*b*' includes a central hole 42 for closely receiving duck bill valve 28 around the exterior thereof. A single offset hole 44 also extends there through and tightly receives tube 8 therein. Spacer 32 is not needed in this embodiment. In operation, bottle connecting portion 40 cooperates with actuating portion 2 in the same manner a above described with bottle connecting portion 1. However, it will be appreciated by those of skill that embodiment 40 provides for the situation where bottle is retained in a "normal" upright position. Thus, gas Qu1 flows directly out of valve 28 into the internal space 16 of bottle 13 and applies "downward" pressure to fluid Qu2 therein whereby fluid Qu2 is forced into the open end of tube 8 adjacent the bottom of the bottle 13 and through tube 8 into and then into chamber 9. Fluid Qu2 can then flow through holes 15, 15' and 15", as described above, for dispensing out of outlet 12.

With the use of carbon dioxide gas ($CO_2$) as the gas Qu1, there will not be less risk of any undesired degradation of the fluid Qu2 from oxidizing or bacterial activity, especially where the fluid Qu2 is a beverage syrup. Of course, the present invention is not exclusively for use in a post mix beverage application but would have application to any situation where a first fluid or gas is used to extract a second fluid retained within a bottle or the like. Therefore, although the invention has been described in terms of a particular embodiment and application, any person skilled in the art, based on these teachings, can generate additional configurations and modifications without the risk of departing from the spirit or extending the scope of the invention as claimed. Consequently, it will be understood that the figures and descriptions disclosed here are given as an example to facilitate the understanding of the invention and not to limit its scope.

What is claimed is:

1. An extraction device providing for the extraction of a liquid from a bottle, the bottle having a bottom end and a cylindrical neck and an exterior surface extending there between defining a liquid containing interior volume, and the cylindrical neck having an open end, an exterior neck surface and an interior neck surface, the exterior neck surface having screw thread means there around and the neck interior surface defining a neck interior area, the extraction device, comprising:

a flow regulating portion for insertion into the bottle through the open neck end thereof and retainably securable to the open neck end, the flow regulating portion having a cylindrical wall portion sized to be received within the neck end and closely adjacent the interior surface thereof, the cylindrical portion having a first open end for positioning adjacent the neck open end and an opposite floor end, the floor end having top and bottom surfaces and having a first hole extending centrally there through and one or more second holes extending there through around an internal perimeter thereof between the first central hole and the cylindrical wall portion, first resilient normally closed one direction valve means in fluid tight securing with the first hole and securable to the floor end bottom surface and second resilient normally closed one direction valve means in fluid tight securing with the one or more second holes and securable to the floor end bottom surface, a flow actuating portion releasably securable with the regulating portion, the flow actuating portion having a fluid connecting member having a gas inlet fitting and a liquid outlet fitting, the gas inlet fitting in fluid communication with a gas channel extending centrally of the connecting member to a distal end thereof the gas channel distal end and a portion of the floor end top surface around the central hole having means for providing liquid tight sealing there between when the flow actuating portion and the flow regulating portion are secured together, and the fluid connecting member having means for opening the second resilient normally closed valve means when the flow actuating portion and the flow regulating portion are secured together, and the fluid connecting member having a fluid path there through fluidly separate from the gas channel for providing sealed fluid communication between the second resilient normally closed valve means and the fluid outlet fitting so that gas under pressure flowing into the gas channel is directed into the first resilient normally closed one direction valve means causing opening thereof for entry of the gas into the bottle interior volume whereby liquid contents of the bottle are forced through the second resilient normally closed valve means into the fluid path and out of the fluid outlet fitting.

2. An extraction device providing for the extraction of a liquid contents of a bottle by the replacement thereof with a gas, the bottle having a body defining an interior volume thereof and having a bottom end and an open neck end, the extraction device, comprising:

a flow regulating portion for insertion into the bottle through the open neck end thereof and securable thereto, the flow regulating portion having a perimeter wall sized to be received within the neck end and held closely adjacent an interior surface thereof, the regulating portion having an open end and an opposite floor end positioned within the bottle neck end, the floor end having top and bottom surfaces and having a gas orifice extending there through and one or more fluid holes extending there through, a normally closed valve in fluid tight securing with the gas orifice and a resilient normally closed member in fluid tight securing with the one or more fluid holes, a flow actuating portion releasably securable with the regulating portion, the flow actuating portion having an exterior housing having a gas inlet fitting and a liquid outlet fitting extending there from at a proximal end thereof and the having a fluid flow opening at a distal end thereof, a gas channel extending through the flow actuating housing providing for exclusive fluid communication between an outlet hole at an outlet end thereof and the inlet fitting, and a fluid passageway extending through the flow actuating housing providing for exclusive fluid communication between the outlet fitting and the fluid flow opening, one or more opening structures extending from the flow actuating portion distal end for insertion into the one or more fluid openings when the flow actuating portion and the flow regulating portion are secured together for deflecting the resilient normally closed member from the one or more fluid openings for permitting fluid flow there through, and the floor end of the flow regulating portion positioned so that when the flow regulating portion and the flow actuating portion are secured together the outlet end of the gas channel contacts the gas orifice of the floor portion whereby seating means provides for fluid tight seating there between so that gas under pressure flowing into the gas channel is directed exclusively into the normally closed valve causing opening thereof for entry of the gas into the bottle interior volume whereby liquid contents of the bottle is forced by such entry of gas to flow through the one or more fluid openings into the fluid passageway and out of the fluid outlet fitting.

3. The extraction device as defined in claim 2, and the gas orifice extending through the center of the flow regulating portion floor end and the one or more fluid holes extending through the floor end around a perimeter thereof between the gas orifice and the perimeter wall.

4. The extraction device as defined in claim 2, and the normally closed valve comprising a duck bill valve secured to a bottom surface of the floor end.

5. The extraction device as defined in claim 2, and the resilient normally closed member comprising a collar of resilient material secured to the bottom surface of the floor end and covering the one or more fluid holes whereby the opening structures operate by insertion thereof into the one or more fluid holes for moving the collar of resilient material away from the normally closed position thereof over the one or more holes.

6. The extraction device as defined in claim 2, and the normally closed valve and the resilient normally closed member comprising a unitary structure of resilient material secured to the bottom surface of the floor end.

7. The extraction device as defined in claim 6, and the normally closed valve comprising a duck bill valve.

8. The extraction device as defined in claim 7, and the resilient normally closed member comprising a collar of resilient material secured to the bottom surface of the floor end and covering the one or more fluid holes whereby the opening structures operate by insertion thereof into the one or more fluid holes for moving the collar of resilient material away from the normally closed position thereof over the one or more holes.

9. The extraction device as defined in claim 3, and the closed valve and the resilient normally closed member comprising a unitary structure of resilient material secured to the bottom surface of the floor end.

10. The extraction device as defined in claim 2, and the flow regulating portion having a gas flow directing member secured thereto and the gas flow directing member having a gas cavity for receiving and providing fluid sealing with a portion of an exterior circumference of the normally closed valve, and the flow directing member having an elongate tube fluidly secured thereto for providing fluid communication from the gas chamber thereof, the elongate tube extending from gas chamber into the bottle interior volume to a position adjacent the bottle bottom end so that gas exiting the normally closed valve is directed into the elongate tube for exiting therefrom adjacent the bottle bottom end.

11. The extraction device as defined in claim 8, and the flow regulating portion having a gas flow directing member secured thereto and the gas flow directing member having a gas cavity for receiving and providing fluid sealing with a portion of an exterior circumference of the normally closed valve, and the flow directing member having an elongate tube fluidly secured thereto for providing fluid communication from the gas chamber thereof, the elongate tube extending from gas chamber into the bottle interior volume to a position adjacent the bottle bottom end so that gas exiting the normally closed valve is directed into the elongate tube for exiting therefrom adjacent the bottle bottom end.

12. The extraction device as defined in claim 2, and the flow regulating portion having a fluid flow directing member secured to a distal end of the flow regulating portion and having a central orifice for providing fluid tight receiving around an exterior circumference of a portion of the normally closed valve therein, and the fluid flow directing member spaced from the end wall bottom surface for creating a fluid chamber between the fluid flow directing member the bottom surface of the end wall, the circumferential portion of the normally closed valve and an interior surface of the perimeter wall of the flow regulating portion, and the fluid flow directing member having a gas tube fluidly secured thereto and extending therefrom into the bottle interior volume adjacent the bottle bottom end.

13. The extraction device as defined in claim 8, and the flow regulating portion having a fluid flow directing member secured to a distal end of the flow regulating portion and having a central orifice for providing fluid tight receiving around an exterior circumference of a portion of the normally closed valve therein, and the fluid flow directing member spaced from the end wall bottom surface for creating a fluid chamber between the fluid flow directing member the bottom surface of the end wall, the circumferential portion of the normally closed valve and an interior surface of the perimeter wall of the flow regulating portion, and the fluid flow directing member having a gas tube fluidly secured thereto and extending therefrom into the bottle interior volume adjacent the bottle bottom end.

14. An extraction device providing for the extraction of a liquid contents of a bottle by the replacement thereof with a gas, the bottle having a body defining an interior volume thereof and having a bottom end and an open neck end, the extraction device, comprising:

a flow regulating portion for insertion into the bottle through the open neck end thereof and securable thereto, the flow regulating portion having a perimeter wall sized to be received within the neck end and held closely adjacent an interior surface thereof, the regulating portion having an open end and an opposite floor end positioned within the bottle neck end, the floor end having top and bottom surfaces and having a gas orifice extending centrally there through and one or more fluid holes extending there through along a perimeter extending around the gas orifice, a first normally closed valve in fluid tight securing with the gas orifice and a resilient normally closed member in fluid tight securing with the one or more fluid holes, a flow actuating portion releasably securable with the regulating portion, the flow actuating portion having an exterior housing having a gas inlet fitting and a liquid outlet fitting extending there from at a proximal end thereof and the housing defining an interior space having a fluid flow opening at a distal end of the flow actuating portion, a gas tube slideably retained within the interior space and moveable against biasing means between a normally closed position and an open position and the gas tube having a central gas passage extending along a central axis thereof providing for fluid communication between an inlet hole at an inlet end thereof and an outlet hole at an outlet end thereof, the gas tube outlet end having an end surface extending transverse to the axial extension of the central passage thereof and the central passage ending with the gas tube outlet hole centrally thereof, and the gas tube outlet end and a perimeter of the interior space fluid flow opening having sealing means there between for preventing fluid flow into the interior space when the gas tube is in the normally closed position, an inlet tube section in the interior space having a first end in fluid tight securing with and extending from the gas inlet fitting partially into the interior space and the gas tube inlet end insertable into the inlet tube section wherein the gas tube inlet hole is received within the inlet tube section and wherein the inlet tube section provides for fluid tight dynamic sealing of the gas tube around an exterior surface thereof, one or more opening structures extending from the flow actuating portion distal end for insertion into the one or more fluid openings when the flow actuating portion and the flow regulating portion are secured together for deflecting the resilient normally closed member from the one or more openings for permitting fluid flow there through, and the floor end of the flow regulating portion positioned so that when the flow regulating portion and the flow actuating portion are secured together the end surface of the gas tube outlet end contacts the top surface whereby the gas tube is moved linearly from its normally closed position to an open position for providing a fluid flow path from the one or more openings into the interior space to the fluid outlet fitting and so that contact is created between the gas tube outlet hole and the gas orifice of the floor portion whereby seating means provides for fluid tight seating there between so that gas under pressure flowing into the gas channel is directed exclusively into the first resilient normally closed valve causing opening thereof for entry of the gas into the bottle interior volume whereby liquid contents of the bottle is forced by such entry of gas to flow through the one or more fluid openings into the interior space and out of the fluid outlet fitting.

15. The extraction device as defined in claim 14, and the gas orifice extending through the center of the flow regulating portion floor end and the one or more fluid holes extending through the floor end around a perimeter thereof between the gas orifice and the perimeter wall.

16. The extraction device as defined in claim 14, and the normally closed valve comprising a duck bill valve secured to a bottom surface of the floor end.

17. The extraction device as defined in claim 14, and the resilient normally closed member comprising a collar of resilient material secured to the bottom surface of the floor end and covering the one or more fluid holes whereby the opening structures operate by insertion thereof into the one or more fluid holes for moving the collar of resilient material away from the normally closed position thereof over the one or more holes.

18. The extraction device as defined in claim 14, and the normally closed valve and the resilient normally closed member comprising a unitary structure of resilient material secured to the bottom surface of the floor end.

19. The extraction device as defined in claim 18, and the normally closed valve comprising a duck bill valve.

20. The extraction device as defined in claim 19, and the resilient normally closed member comprising a collar of resilient material secured to the bottom surface of the floor end and covering the one or more fluid holes whereby the opening structures operate by insertion thereof into the one or more fluid holes for moving the collar of resilient material away from the normally closed position thereof over the one or more holes.

21. The extraction device as defined in claim 15, and the closed valve and the resilient normally closed member comprising a unitary structure of resilient material secured to the bottom surface of the floor end.

22. The extraction device as defined in claim 14, and the flow regulating portion having a gas flow directing member secured thereto and the gas flow directing member having a gas cavity for receiving and providing fluid sealing with a portion of an exterior circumference of the normally closed valve, and the flow directing member having an elongate tube fluidly secured thereto for providing fluid communication from the gas chamber thereof, the elongate tube extending from gas chamber into the bottle interior volume to a position adjacent the bottle bottom end so that gas exiting the normally closed valve is directed into the elongate tube for exiting therefrom adjacent the bottle bottom end.

23. The extraction device as defined in claim 20, and the flow regulating portion having a gas flow directing member secured thereto and the gas flow directing member having a gas cavity for receiving and providing fluid sealing with a portion of an exterior circumference of the normally closed valve, and the flow directing member having an elongate tube fluidly secured thereto for providing fluid communication from the gas chamber thereof, the elongate tube extending from gas chamber into the bottle interior volume to a position adjacent the bottle bottom end so that gas exiting the normally closed valve is directed into the elongate tube for exiting therefrom adjacent the bottle bottom end.

24. The extraction device as defined in claim 14, and the flow regulating portion having a fluid flow directing member secured to a distal end of the flow regulating portion and having a central orifice for providing fluid tight receiving around an exterior circumference of a portion of the normally closed valve therein, and the fluid flow directing member spaced from the end wall bottom surface for creating a fluid chamber between the fluid flow directing member the bottom surface of the end wall, the circumferential portion of the normally closed valve and an interior surface of the perimeter wall of the flow regulating portion, and the fluid flow directing member having a gas tube fluidly secured thereto and extending therefrom into the bottle interior volume adjacent the bottle bottom end.

25. The extraction device as defined in claim 20, and the flow regulating portion having a fluid flow directing member secured to a distal end of the flow regulating portion and having a central orifice for providing fluid tight receiving around an exterior circumference of a portion of the normally closed valve therein, and the fluid flow directing member spaced from the end wall bottom surface for creating a fluid chamber between the fluid flow directing member the bottom surface of the end wall, the circumferential portion of the normally closed valve and an interior surface of the perimeter wall of the flow regulating portion, and the fluid flow directing member having a gas tube fluidly secured thereto and extending therefrom into the bottle interior volume adjacent the bottle bottom end.

* * * * *